US006479774B1

(12) United States Patent
Castonguay et al.

(10) Patent No.: US 6,479,774 B1
(45) Date of Patent: Nov. 12, 2002

(54) HIGH ENERGY CLOSING MECHANISM FOR CIRCUIT BREAKERS

(75) Inventors: Roger N. Castonguay, Terryville, CT (US); Dave Christensen, Harwinton, CT (US)

(73) Assignee: General Electric Company, Schenectady, NY (US)

( * ) Notice: Subject to any disclaimer, the term of this patent is extended or adjusted under 35 U.S.C. 154(b) by 85 days.

(21) Appl. No.: 09/685,167

(22) Filed: Oct. 10, 2000

Related U.S. Application Data

(60) Provisional application No. 60/190,295, filed on Mar. 17, 2000.

(51) Int. Cl.[7] ..... H01H 23/00

(52) U.S. Cl. ..... 200/401; 200/244; 335/167

(58) Field of Search ..... 200/400, 401, 200/244, 335; 335/167, 176, 168, 169, 170, 171, 172, 173, 174, 175

(56) References Cited

U.S. PATENT DOCUMENTS

| | | | | |
|---|---|---|---|---|
| 2,340,682 A | | 2/1944 | Powell | 200/147 |
| 2,719,203 A | | 9/1955 | Gelzheiser et al. | 200/144 |
| 2,937,254 A | | 5/1960 | Ericson | 200/114 |
| 3,158,717 A | | 11/1964 | Jencks et al. | 200/116 |
| 3,162,739 A | | 12/1964 | Klein et al. | 200/88 |
| 3,197,582 A | | 7/1965 | Norden | 200/50 |
| 3,307,002 A | | 2/1967 | Cooper | 200/116 |
| 3,517,356 A | | 6/1970 | Hanafusa | 335/16 |
| 3,562,469 A | * | 2/1971 | Peck | 200/169 |
| 3,631,369 A | | 12/1971 | Menocal | 337/110 |
| 3,803,455 A | | 4/1974 | Willard | 317/33 SC |
| 3,883,781 A | | 5/1975 | Cotton | 317/14 R |
| 4,129,762 A | | 12/1978 | Bruchet | 200/153 G |
| 4,144,513 A | | 3/1979 | Shafer et al. | 335/46 |
| 4,158,119 A | | 6/1979 | Krakik | 200/240 |
| 4,165,453 A | | 8/1979 | Hennemann | 200/153 G |
| 4,166,988 A | | 9/1979 | Ciarcia et al. | 335/9 |
| 4,220,934 A | | 9/1980 | Wafer et al. | 335/16 |
| 4,255,732 A | | 3/1981 | Wafer et al. | 335/16 |
| 4,259,651 A | | 3/1981 | Yamat | 335/16 |

(List continued on next page.)

FOREIGN PATENT DOCUMENTS

| | | |
|---|---|---|
| BE | 819 008 A | 12/1974 |
| BE | 897 691 A | 1/1984 |
| DE | 12 27 978 | 11/1966 |
| DE | 30 47 360 | 6/1982 |
| DE | 38 02 184 | 8/1989 |
| DE | 38 43 277 | 6/1990 |
| DE | 44 19 240 | 1/1995 |
| EP | 0 061 092 | 9/1982 |
| EP | 0 064 906 | 11/1982 |
| EP | 0 066 486 | 12/1982 |
| EP | 0 076 719 | 4/1983 |
| EP | 0 117 094 | 8/1984 |
| EP | 0 140 761 | 5/1985 |
| EP | 0 174 904 | 3/1986 |
| EP | 0 196 241 | 10/1986 |

(List continued on next page.)

*Primary Examiner*—Elvin Enad
*Assistant Examiner*—Kyung S. Lee
(74) *Attorney, Agent, or Firm*—Cantor Colburn LLP

(57) ABSTRACT

A circuit breaker operating mechanism comprises a movable handle yoke, a mechanism spring extending in tension from the handle yoke to a pin, and a lower link extending from the pin to a crank operably connected to a contact arm bearing a movable contact. The crank is positionable in open and closed positions, being in an open position when the movable contact is separated from an associated fixed contact and being in a closed position when the movable contact is mated to said associated fixed contact. The circuit breaker further comprises an interface formed on said crank and a blocking prop having a first surface that engages said interface, the first surface preventing the crank from rotating towards the closed position.

8 Claims, 13 Drawing Sheets

U.S. PATENT DOCUMENTS

| | | | | |
|---|---|---|---|---|
| 4,263,492 | A | 4/1981 | Maier et al. | 200/288 |
| 4,276,527 | A | 6/1981 | Gerbert-Gaillard et al. | 335/39 |
| 4,297,663 | A | 10/1981 | Seymour et al. | 335/20 |
| 4,301,342 | A | 11/1981 | Castonguay et al. | 200/153 SC |
| 4,360,852 | A | 11/1982 | Gilmore | 361/98 |
| 4,368,444 | A | 1/1983 | Preuss et al. | 335/166 |
| 4,375,021 | A | 2/1983 | Pardini et al. | 200/147 B |
| 4,375,022 | A | 2/1983 | Daussin et al. | 200/148 R |
| 4,376,270 | A | 3/1983 | Staffen | 335/21 |
| 4,383,146 | A | 5/1983 | Bur | 200/17 R |
| 4,392,036 | A | 7/1983 | Troebel et al. | 200/322 |
| 4,393,283 | A | 7/1983 | Masuda | 200/51.09 |
| 4,401,872 | A | 8/1983 | Boichot-Castagne et al. | 200/153 G |
| 4,409,573 | A | 10/1983 | DiMarco et al. | 335/16 |
| 4,435,690 | A | 3/1984 | Link et al. | 335/37 |
| 4,467,297 | A | 8/1984 | Boichot-Castagne et al. | 335/8 |
| 4,468,645 | A | 8/1984 | Gerbert-Gaillard et al. | 335/42 |
| 4,470,027 | A | 9/1984 | Link et al. | 335/16 |
| 4,479,143 | A | 10/1984 | Watanabe et al. | 358/44 |
| 4,488,133 | A | 12/1984 | McClellan et al. | 335/16 |
| 4,492,941 | A | 1/1985 | Nagel | 335/13 |
| 4,541,032 | A | 9/1985 | Schwab | 361/331 |
| 4,546,224 | A | 10/1985 | Mostosi | 200/153 G |
| 4,550,360 | A | 10/1985 | Dougherty | 361/93 |
| 4,562,419 | A | 12/1985 | Preuss et al. | 335/195 |
| 4,589,052 | A | 5/1986 | Dougherty | 361/94 |
| 4,595,812 | A | 6/1986 | Tamaru et al. | 200/307 |
| 4,611,187 | A | 9/1986 | Banfi | 335/16 |
| 4,612,430 | A | 9/1986 | Sloan et al. | 200/327 |
| 4,616,198 | A | 10/1986 | Pardini | 335/16 |
| 4,622,444 | A | 11/1986 | Kandatsu et al. | 200/303 |
| 4,631,625 | A | 12/1986 | Alexander et al. | 361/94 |
| 4,642,431 | A | 2/1987 | Tedesco et al. | 200/153 G |
| 4,644,438 | A | 2/1987 | Puccinelli et al. | 361/75 |
| 4,649,247 | A | 3/1987 | Preuss et al. | 200/244 |
| 4,658,322 | A | 4/1987 | Rivera | 361/37 |
| 4,672,501 | A | 6/1987 | Bilac et al. | 361/96 |
| 4,675,481 | A | 6/1987 | Markowski et al. | 200/144 R |
| 4,682,264 | A | 7/1987 | Demeyer | 361/96 |
| 4,689,712 | A | 8/1987 | Demeyer | 361/96 |
| 4,694,373 | A | 9/1987 | Demeyer | 361/96 |
| 4,710,845 | A | 12/1987 | Demeyer | 361/96 |
| 4,717,985 | A | 1/1988 | Demeyer | 361/96 |
| 4,733,211 | A | 3/1988 | Castonguay et al. | 335/192 |
| 4,733,321 | A | 3/1988 | Lindeperg | 361/96 |
| 4,764,650 | A | 8/1988 | Bur et al. | 200/153 G |
| 4,768,007 | A | 8/1988 | Mertz et al. | 335/202 |
| 4,780,786 | A | 10/1988 | Weynacher et al. | 361/87 |
| 4,831,221 | A | 5/1989 | Yu et al. | 200/553 |
| 4,870,531 | A | 9/1989 | Danek | 361/93 |
| 4,883,931 | A | 11/1989 | Batteux et al. | 200/148 R |
| 4,884,047 | A | 11/1989 | Baginski et al. | 335/10 |
| 4,884,164 | A | 11/1989 | Dziura et al. | 361/97 |
| 4,900,882 | A | 2/1990 | Bernard et al. | 200/147 R |
| 4,910,485 | A | 3/1990 | Bolongeat-Mobleu et al. | 335/195 |
| 4,914,541 | A | 4/1990 | Tripodi et al. | 361/94 |
| 4,916,420 | A | 4/1990 | Bartolo et al. | 335/172 |
| 4,916,421 | A | 4/1990 | Pardini et al. | 335/185 |
| 4,926,282 | A | 5/1990 | McGhie | 361/102 |
| 4,935,590 | A | 6/1990 | Malkin et al. | 200/148 A |
| 4,937,706 | A | 6/1990 | Schueller et al. | 361/396 |
| 4,939,492 | A | 7/1990 | Raso et al. | 335/42 |
| 4,943,691 | A | 7/1990 | Mertz et al. | 200/151 |
| 4,943,888 | A | 7/1990 | Jacob et al. | 361/96 |
| 4,950,855 | A | 8/1990 | Bolonegeat-Mobleu et al. | 200/148 A |
| 4,951,019 | A | 8/1990 | Gula | 335/166 |
| 4,952,897 | A | 8/1990 | Barnel et al. | 335/147 |
| 4,958,135 | A | 9/1990 | Baginski et al. | 335/8 |
| 4,965,543 | A | 10/1990 | Batteux | 335/174 |
| 4,983,788 | A | 1/1991 | Pardini | 200/16 R |
| 5,001,313 | A | 3/1991 | Leclerq et al. | 200/148 B |
| 5,004,878 | A | 4/1991 | Seymour et al. | 200/144 R |
| 5,029,301 | A | 7/1991 | Nebon et al. | 335/16 |
| 5,030,804 | A | 7/1991 | Abri | 200/323 |
| 5,057,655 | A | 10/1991 | Kersusan et al. | 200/148 B |
| 5,077,627 | A | 12/1991 | Fraisse | 361/93 |
| 5,083,081 | A | 1/1992 | Barrault et al. | 324/126 |
| 5,095,183 | A | 3/1992 | Raphard et al. | 200/148 A |
| 5,103,198 | A | 4/1992 | Morel et al. | 335/6 |
| 5,115,371 | A | 5/1992 | Tripodi | 361/106 |
| 5,120,921 | A | 6/1992 | DiMarco et al. | 200/401 |
| 5,132,865 | A | 7/1992 | Mertz et al. | 361/6 |
| 5,138,121 | A | 8/1992 | Streich et al. | 200/293 |
| 5,140,115 | A | 8/1992 | Morris | 200/308 |
| 5,153,802 | A | 10/1992 | Mertz et al. | 361/18 |
| 5,155,315 | A | 10/1992 | Malkin et al. | 200/148 R |
| 5,166,483 | A | 11/1992 | Kersusan et al. | 200/144 A |
| 5,172,087 | A | 12/1992 | Castonguay et al. | 335/160 |
| 5,178,504 | A | 1/1993 | Falchi | 411/553 |
| 5,184,717 | A | 2/1993 | Chou et al. | 200/401 |
| 5,187,339 | A | 2/1993 | Lissandrin | 200/148 F |
| 5,198,956 | A | 3/1993 | Dvorak | 361/106 |
| 5,200,724 | A | 4/1993 | Gula et al. | 335/166 |
| 5,210,385 | A | 5/1993 | Morel et al. | 200/146 R |
| 5,239,150 | A | 8/1993 | Bolongeat-Mobleu et al. | 200/148 R |
| 5,260,533 | A | 11/1993 | Livesey et al. | 200/401 |
| 5,262,744 | A | 11/1993 | Arnold et al. | 335/8 |
| 5,280,144 | A | 1/1994 | Bolongeat-Mobleu et al. | 200/148 R |
| 5,281,776 | A | 1/1994 | Morel et al. | 200/144 |
| 5,296,660 | A | 3/1994 | Morel et al. | 200/146 R |
| 5,296,664 | A | 3/1994 | Crookston et al. | 200/401 |
| 5,298,874 | A | 3/1994 | Morel et al. | 335/8 |
| 5,300,907 | A | 4/1994 | Nereau et al. | 335/172 |
| 5,310,971 | A | 5/1994 | Vial et al. | 200/244 |
| 5,313,180 | A | 5/1994 | Vial et al. | 335/16 |
| 5,317,471 | A | 5/1994 | Izoard et al. | 361/105 |
| 5,331,500 | A | 7/1994 | Corcoles et al. | 361/93 |
| 5,334,808 | A | 8/1994 | Bur et al. | 200/50 |
| 5,341,191 | A | 8/1994 | Crookston et al. | 335/16 |
| 5,347,096 | A | 9/1994 | Bolongeat-Mobleu et al. | 200/148 B |
| 5,347,097 | A | 9/1994 | Bolongeat-Mobleu et al. | 200/148 B |
| 5,350,892 | A | 9/1994 | Rozier | 200/144 B |
| 5,357,066 | A | 10/1994 | Morel et al. | 200/17 R |
| 5,357,068 | A | 10/1994 | Rozier | 200/148 R |
| 5,357,394 | A | 10/1994 | Piney | 361/72 |
| 5,361,052 | A | 11/1994 | Ferullo et al. | 335/172 |
| 5,373,130 | A | 12/1994 | Barrault et al. | 200/147 R |
| 5,379,013 | A | 1/1995 | Coudert | 335/17 |
| 5,424,701 | A | 6/1995 | Castonguary et al. | 335/172 |
| 5,438,176 | A | 8/1995 | Bonnardel et al. | 200/400 |
| 5,440,088 | A | 8/1995 | Coudert et al. | 200/303 |
| 5,449,871 | A | 9/1995 | Batteux et al. | 200/401 |
| 5,450,048 | A | 9/1995 | Leger et al. | 335/132 |
| 5,451,729 | A | 9/1995 | Onderka et al. | 200/18 |
| 5,457,295 | A | 10/1995 | Tanibe et al. | 200/293 |
| 5,467,069 | A | 11/1995 | Payet-Burin et al. | 335/42 |
| 5,469,121 | A | 11/1995 | Payet-Burin | 335/16 |
| 5,475,558 | A | 12/1995 | Barjonnet et al. | 361/64 |
| 5,477,016 | A | 12/1995 | Baginski et al. | 200/43.11 |
| 5,479,143 | A | 12/1995 | Payet-Burin | 335/202 |
| 5,483,212 | A | 1/1996 | Lankuttis et al. | 335/132 |
| 5,485,343 | A | 1/1996 | Santos et al. | 361/115 |
| D367,265 | S | 2/1996 | Yamagata et al. | D13/160 |
| 5,493,083 | A | 2/1996 | Olivier | 200/17 R |

| | | | | | |
|---|---|---|---|---|---|
| 5,504,284 | A | | 4/1996 | Lazareth et al. | 200/50 R |
| 5,504,290 | A | | 4/1996 | Baginski et al. | 200/401 |
| 5,510,761 | A | | 4/1996 | Boder et al. | 335/172 |
| 5,512,720 | A | | 4/1996 | Coudert et al. | 200/400 |
| 5,515,018 | A | | 5/1996 | DiMarco et al. | 335/16 |
| 5,519,561 | A | | 5/1996 | Mrenna et al. | 361/105 |
| 5,534,674 | A | | 7/1996 | Steffens | 218/154 |
| 5,534,832 | A | | 7/1996 | Duchemin et al. | 335/16 |
| 5,534,835 | A | | 7/1996 | McColloch et al. | 335/172 |
| 5,534,840 | A | | 7/1996 | Cuingnet | 337/1 |
| 5,539,168 | A | | 7/1996 | Linzenich | 200/303 |
| 5,543,595 | A | * | 8/1996 | Mader et al. | 200/401 |
| 5,552,755 | A | | 9/1996 | Fello et al. | 335/18 |
| 5,581,219 | A | | 12/1996 | Nozawa et al. | 335/132 |
| 5,604,656 | A | | 2/1997 | Derrick et al. | 361/187 |
| 5,608,367 | A | * | 3/1997 | Zoller et al. | 335/132 |
| 5,784,233 | A | | 7/1998 | Bastard et al. | 361/36 |

FOREIGN PATENT DOCUMENTS

| | | | |
|---|---|---|---|
| EP | 0 224 396 | | 6/1987 |
| EP | 0 235 479 | | 9/1987 |
| EP | 0 239 460 | | 9/1987 |
| EP | 0 258 090 | | 3/1988 |
| EP | 0 264 313 | | 4/1988 |
| EP | 0 264 314 | | 4/1988 |
| EP | 0 283 189 | | 9/1988 |
| EP | 0 283 358 | | 9/1988 |
| EP | 0 291 374 | | 11/1988 |
| EP | 0 295 155 | | 12/1988 |
| EP | 0 295 158 | | 12/1988 |
| EP | 0 309 923 | | 4/1989 |
| EP | 0 313 106 | | 4/1989 |
| EP | 0 313 422 | | 4/1989 |
| EP | 0 314 540 | | 5/1989 |
| EP | 0 331 586 | | 9/1989 |
| EP | 0 337 900 | | 10/1989 |
| EP | 0 342 133 | | 11/1989 |
| EP | 0 367 690 | | 5/1990 |
| EP | 0 371 887 | | 6/1990 |
| EP | 0 375 568 | | 6/1990 |
| EP | 0 394 144 | | 10/1990 |
| EP | 0 394 922 | | 10/1990 |
| EP | 0 399 282 | | 11/1990 |
| EP | 0 407 310 | | 1/1991 |
| EP | 0 452 230 | | 10/1991 |
| EP | 42 01 255 | A | 7/1992 |
| EP | 0 555 158 | | 8/1993 |
| EP | 0 560 697 | | 9/1993 |
| EP | 0 567 416 | | 10/1993 |
| EP | 0 595 730 | | 5/1994 |
| EP | 0 619 591 | | 10/1994 |
| EP | 0 665 569 | | 8/1995 |
| EP | 0 700 140 | | 3/1996 |
| EP | 0 889 498 | | 1/1999 |
| FR | 2 410 353 | | 6/1979 |
| FR | 2 512 582 | | 3/1983 |
| FR | 2 553 943 | | 4/1985 |
| FR | 2 592 998 | | 7/1987 |
| FR | 2 682 531 | | 4/1993 |
| FR | 2 697 670 | | 5/1994 |
| FR | 2 699 324 | | 6/1994 |
| FR | 2 714 771 | | 7/1995 |
| GB | 2 233 155 | | 1/1991 |
| SU | 1 227 978 | | 4/1986 |
| WO | 92/00598 | | 1/1992 |
| WO | 92/05649 | | 4/1992 |
| WO | 94/00901 | | 1/1994 |
| WO | WO 99 62092 | A | 12/1999 |

* cited by examiner

HIGH ENERGY CLOSING MECHANISM FOR CIRCUIT BREAKERS

CROSS REFERENCE TO RELATED APPLICATIONS

This application claims benefit of earlier-filed U.S. Provisional Application Ser. No. 60/190,295, filed Mar. 17, 2000, which is fully incorporated herein by reference.

BACKGROUND OF THE INVENTION

The present invention is directed to circuit interrupters, and more particularly to circuit interrupter operating mechanisms.

Circuit interrupter operating mechanisms are used to manually control the opening and closing of movable contact structures within circuit interrupters. These operating mechanisms will rapidly open the movable contact structure and interrupt the circuit in response to a trip signal from an actuator or other device. To transfer the forces when manually controlling the contact structure or when an actuator rapidly trips the structure, operating mechanisms employ powerful operating springs and linkage arrangements. The spring energy provided by the operating springs preferably provides a high output force to the separable contacts.

Commonly, multiple contacts, each disposed within a cassette, are arranged within a circuit breaker system for protection of individual phases of current. The operating mechanism is positioned over one of the cassettes and generally connected to all of the cassettes in the system. Because of the close position between each of the cassettes, and between each cassette and the operating mechanism, the space available for movable components is minimal. A typical problem for the rotary type circuit breaker is that minimal space is allowed for the operating mechanism, while the rotor design requires a high output from the operating mechanism to close the circuit breaker contacts. Circuit breakers of the prior art have addressed this problem by increasing the size of the breaker to accommodate the larger operating springs.

When closing the contacts, the circuit breaker operating handle is normally rotated to its "full closed position". However, this is not always the case. The operator manipulating the handle may move the handle to less than the full closed position or may move the handle to the fully closed position in a slow manner. In either case, the operating mechanism may close the contacts, but with less force than if the handle was moved to the fully closed position. By controlling the relationship between the handle position and contact movement, a more efficient higher-output mechanism can be obtained.

BRIEF SUMMARY OF THE INVENTION

The above discussed increased mechanism efficiency is achieved by a circuit breaker operating mechanism comprising a movable handle yoke, a mechanism spring extending in tension from the handle yoke to a pin, and a lower link extending from the pin to a crank operably connected to a contact arm bearing a movable contact. The crank is positionable in open and closed positions, being in an open position when the movable contact is separated from an associated fixed contact and being in a closed position when the movable contact is mated to said associated fixed contact. The circuit breaker further comprises an interface formed on said crank and a blocking prop having a first surface that engages said interface, the first surface preventing the crank from rotating towards the closed position.

BRIEF DESCRIPTION OF THE DRAWINGS

Referring to the Figures wherein like elements are numbered alike in the several Figures

DETAILED DESCRIPTION OF THE INVENTION

Figure 1:
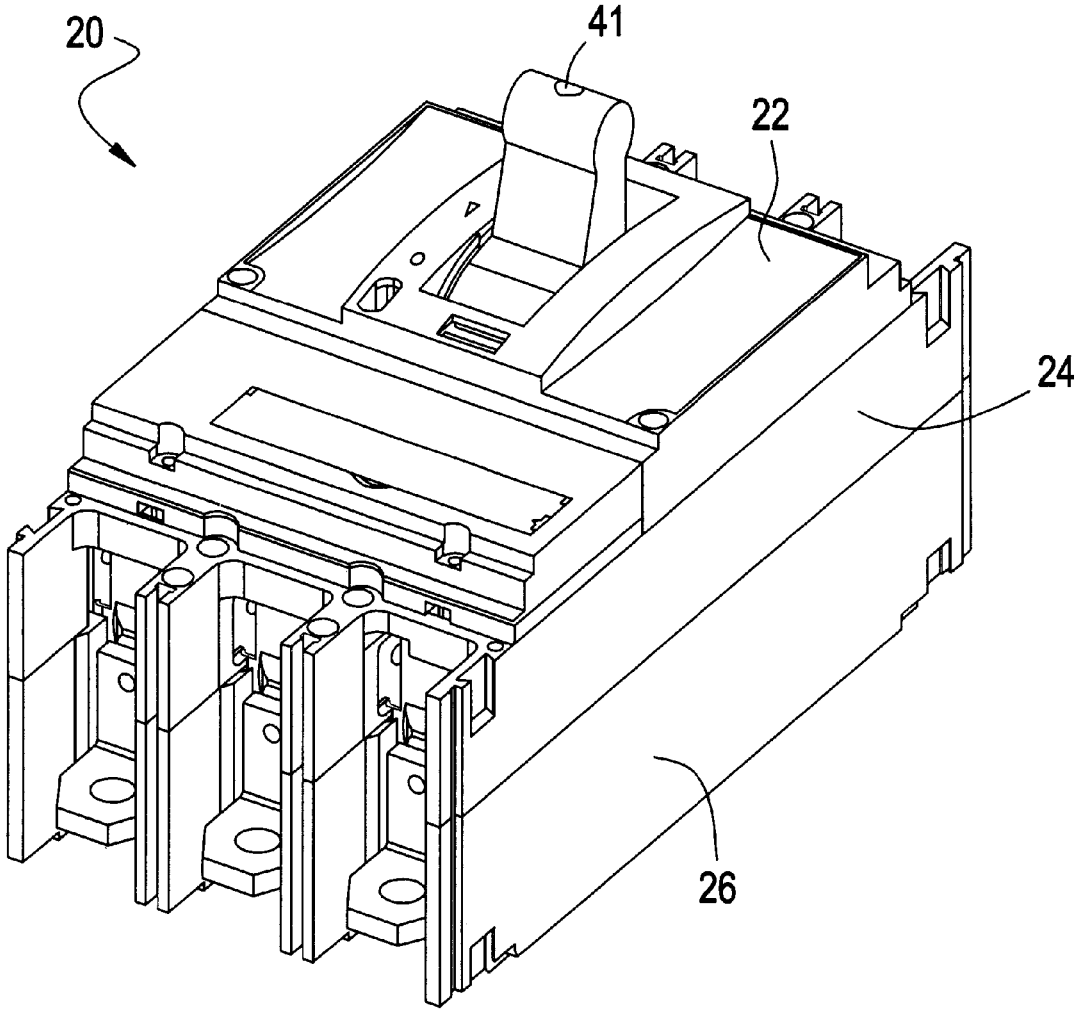
FIG. 1 is an isometric view of a molded case circuit breaker employing an operating mechanism embodied by the present invention.
Figure 2:
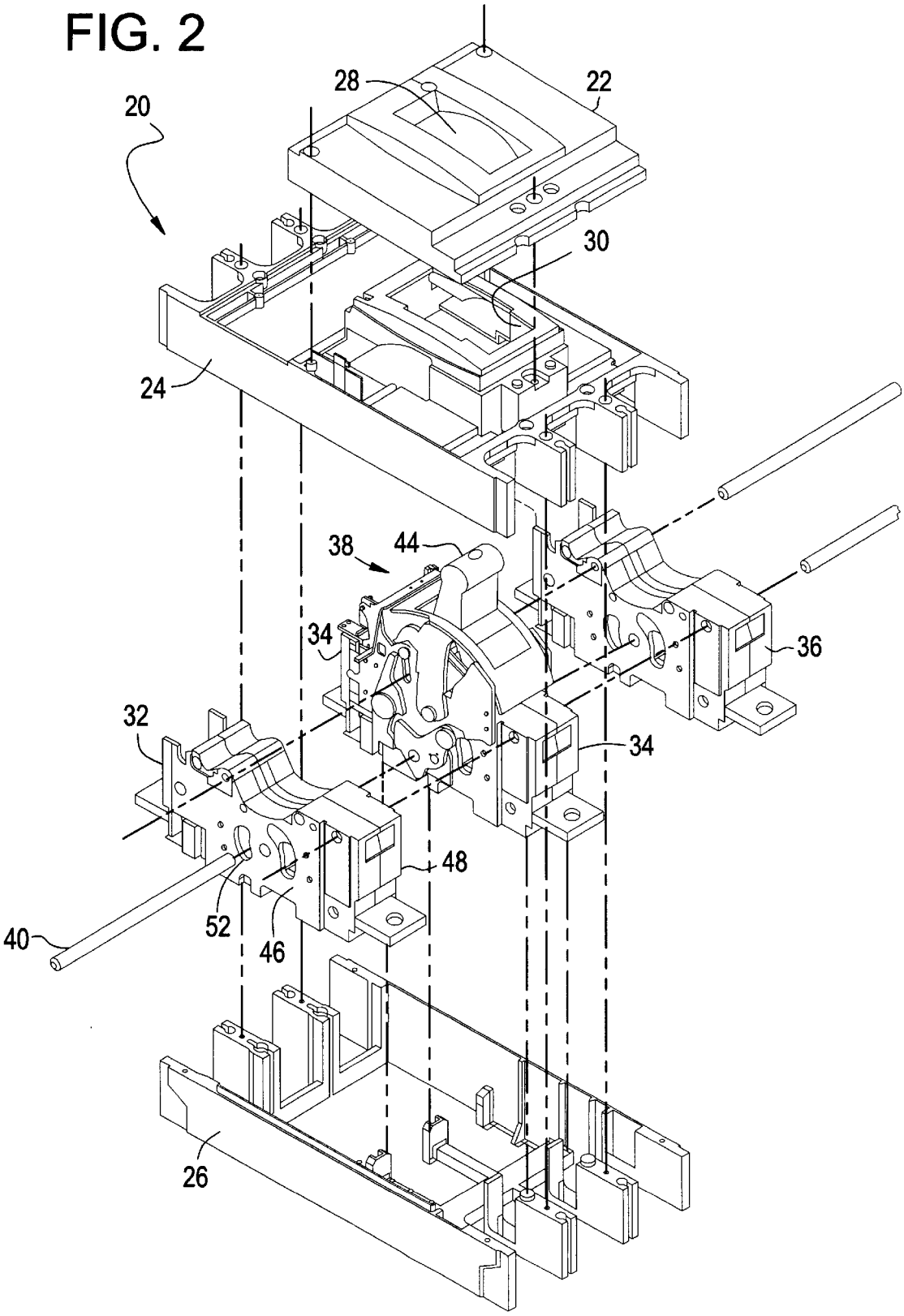
FIG. 2 is an exploded view of the circuit breaker of FIG. 1.

In an exemplary embodiment of the present invention, and referring to FIGS. 1 and 2, a circuit breaker 20 is shown. Circuit breaker 20 generally includes a molded case having a top cover 22 attached to a mid cover 24 coupled to a base 26. An opening 28, formed generally centrally within top cover 22, is positioned to mate with a corresponding mid cover opening 30, which is accordingly aligned with opening 28 when mid cover 24 and top cover 22 are coupled to one another.

In a 3-pole system (i.e., corresponding with three phases of current), three rotary cassettes 32, 34 and 36 are disposed within base 26. Cassettes 32, 34 and 36 are commonly operated by an interface between an operating mechanism 38 via a cross pin 40. Operating mechanism 38 is positioned and configured atop cassette 34, which is generally disposed intermediate to cassettes 32 and 36. Operating mechanism 38 operates substantially as described herein and as described in U.S. patent application Ser. No. 09/196,706 entitled "Circuit Breaker Mechanism for a Rotary Contact Assembly".

A toggle handle 44 extends through openings 28 and 30 and allows for external operation of cassettes 32, 34 and 36.

Examples of rotary contact structures that may be operated by operating mechanism 38 are described in more detail in U.S. patent application Ser. Nos. 09/087,038 and 09/384,908, both entitled "Rotary Contact Assembly For High-Ampere Rated Circuit Breakers", and U.S. patent application Ser. No. 09/384,495, entitled "Supplemental Trip Unit For Rotary Circuit Interrupters". Cassettes 32, 34, 36 are typically formed of high strength plastic material and each include opposing sidewalls 46, 48. Sidewalls 46, 48 have an arcuate slot 52 positioned and configured to receive and allow the motion of cross pin 40 by action of operating mechanism 38.

Figure 3:
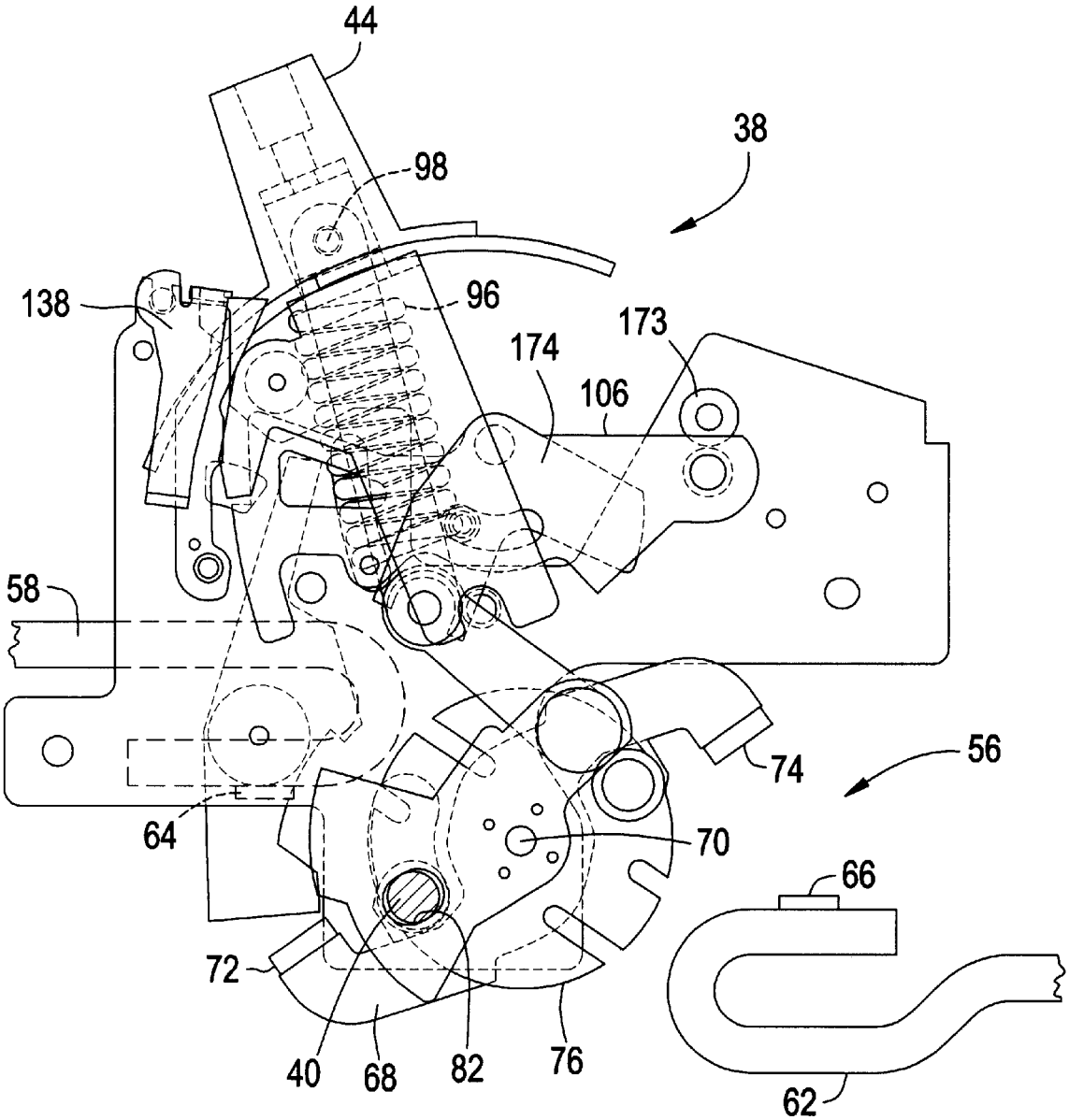
FIG. 3 is a partial sectional view of a rotary contact structure and operating mechanism embodied by the present invention in the "off" position.
Figure 4:
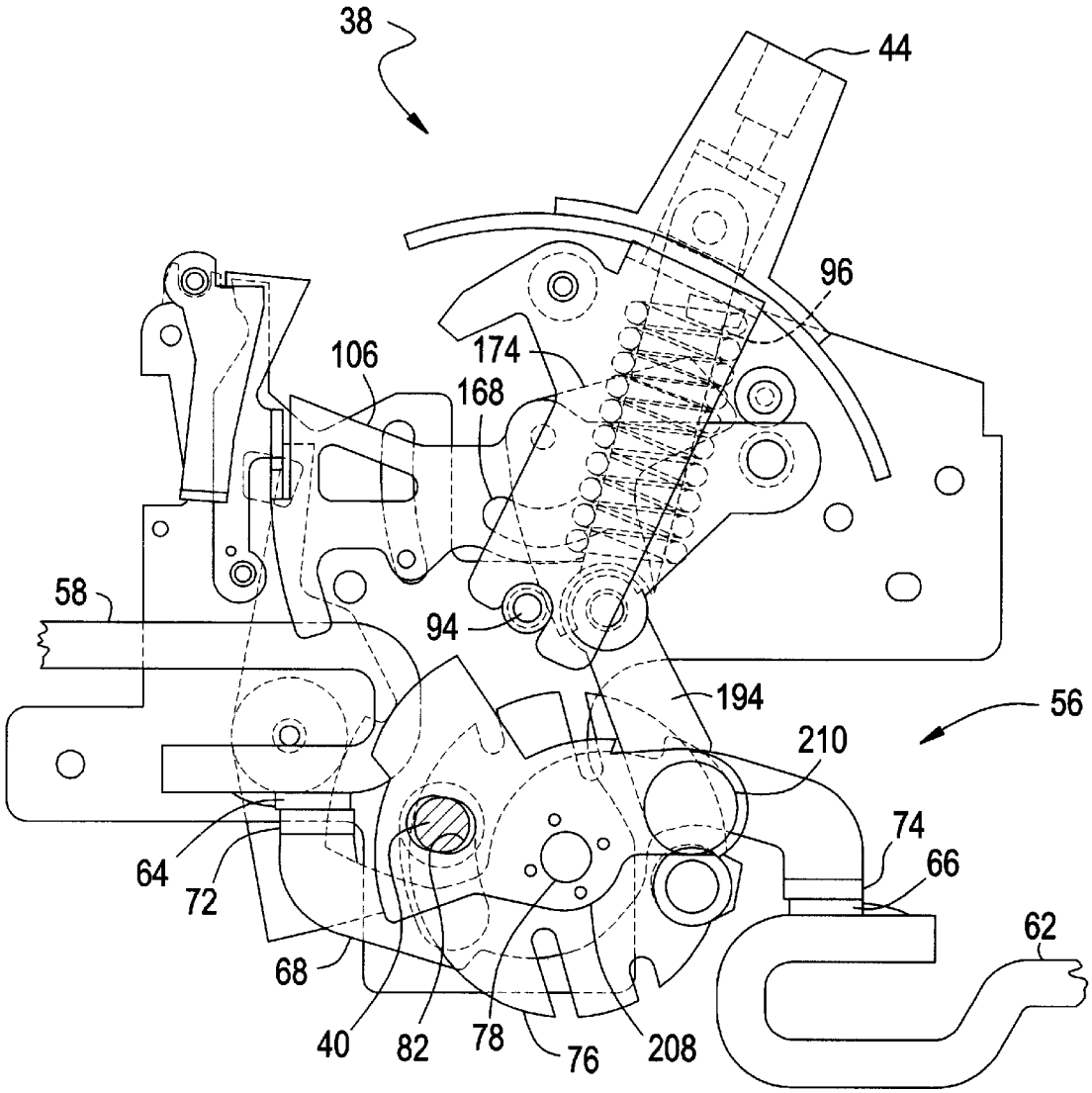
FIG. 4 is a partial sectional view of the rotary contact structure and operating mechanism of FIG. 3 in the "on" position.
Figure 5:
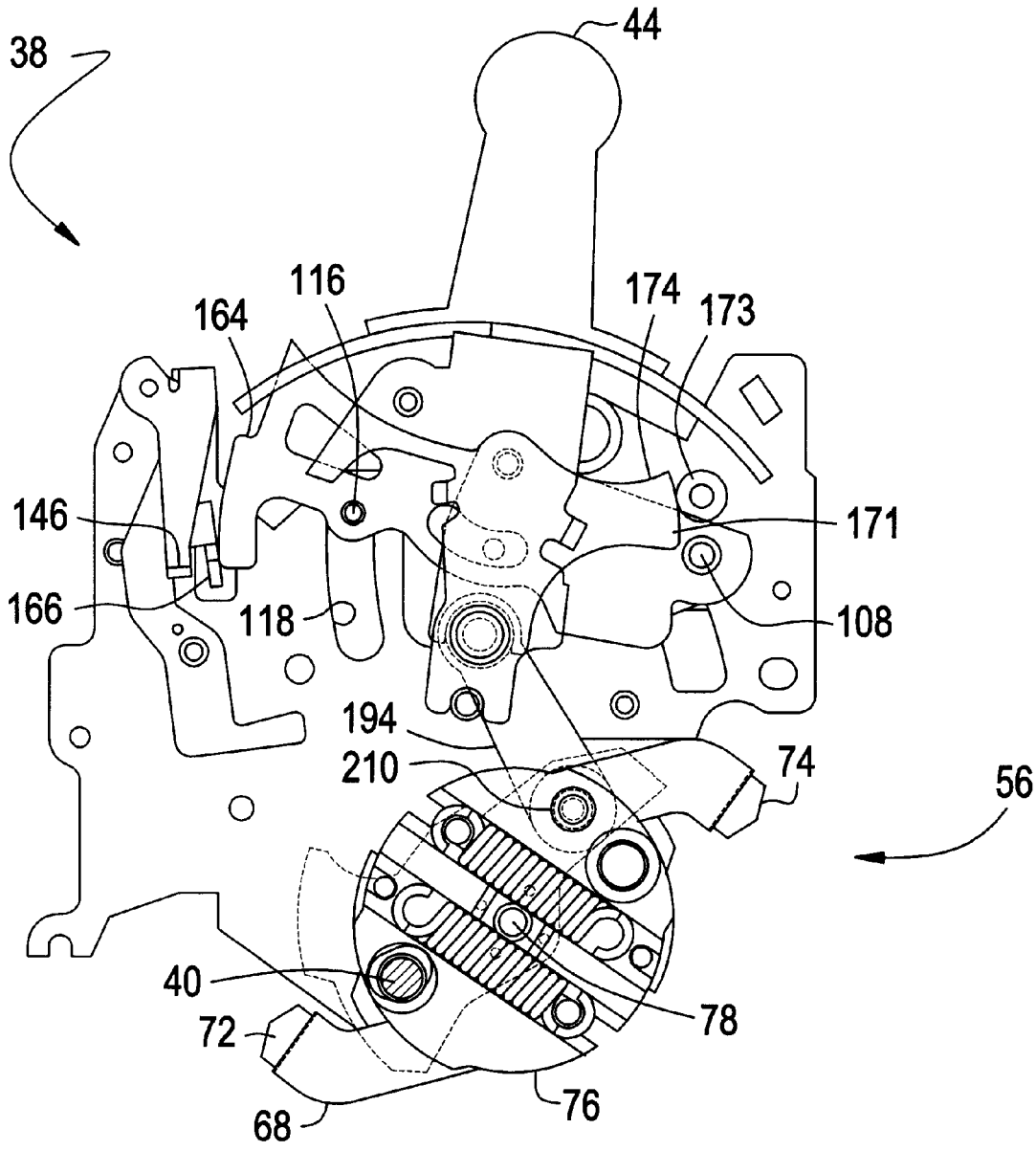
FIG. 5 is a partial sectional view of the rotary contact structure and operating mechanism of FIGS. 3 and 4 in the "tripped" position.

Referring now to FIGS. 3, 4, and 5, an exemplary rotary contact assembly 56 that is disposed within each cassette 32, 34, 36 is shown in the "off", "on" and "tripped" conditions, respectively. Also depicted are partial side views of operating mechanism 38, the components of which are described in greater detail further herein. Rotary contact assembly 56 includes a load side contact strap 58 and line side contact strap 62 for connection with a power source and a protected circuit (not shown), respectively. Load side contact strap 58 includes a stationary contact 64 and line side contact strap 62 includes a stationary contact 66. Rotary contact assembly 56 further includes a movable contact arm 68 having a set of contacts 72 and 74 that mate with stationary contacts 64 and 66, respectively. In the "off" position (FIG. 3) of operating mechanism 38, wherein toggle handle 44 is oriented to the left (e.g., via a manual or mechanical force), contacts 72 and 74 are separated from stationary contacts 64 and 66, thereby preventing current from flowing through contact arm 68.

In the "on" position (FIG. 4) of operating mechanism 38, wherein toggle handle 44 is oriented to the right as depicted in FIG. 3 (e.g., via a manual or mechanical force), contacts 72 and 74 are mated with stationary contacts 64 and 66, thereby allowing current to flow through contact arm 68. In the "tripped" position (FIG. 5) of operating mechanism 38, toggle handle 44 is oriented between the "on" position and the "off" position (typically by the release of mechanism springs within operating mechanism 38, described in greater detail herein). In this "tripped" position, contacts 72 and 74 are separated from stationary contacts 64 and 66 by the action of operating mechanism 38, thereby preventing current from flowing through contact arm 68. After operating mechanism 38 is in the "tripped" position, it must ultimately be returned to the "on" position for operation. This is effectuated by applying a reset force to move toggle handle 44 to a "reset" condition, which is beyond the "off" position (i.e., further to the left of the "off" position in FIG. 3), and then back to the "on" position. This reset force must be high enough to overcome the mechanism springs, described herein.

Contact arm 68 is mounted on a rotor structure 76 that houses one or more sets of contact springs (not shown). Contact arm 68 and rotor structure 76 pivot about a common center 78. Cross pin 40 interfaces through an opening 82 within rotor structure 76 generally to cause contact arm 68 to be moved from the "on", "off" and "tripped" position.

Figure 6:
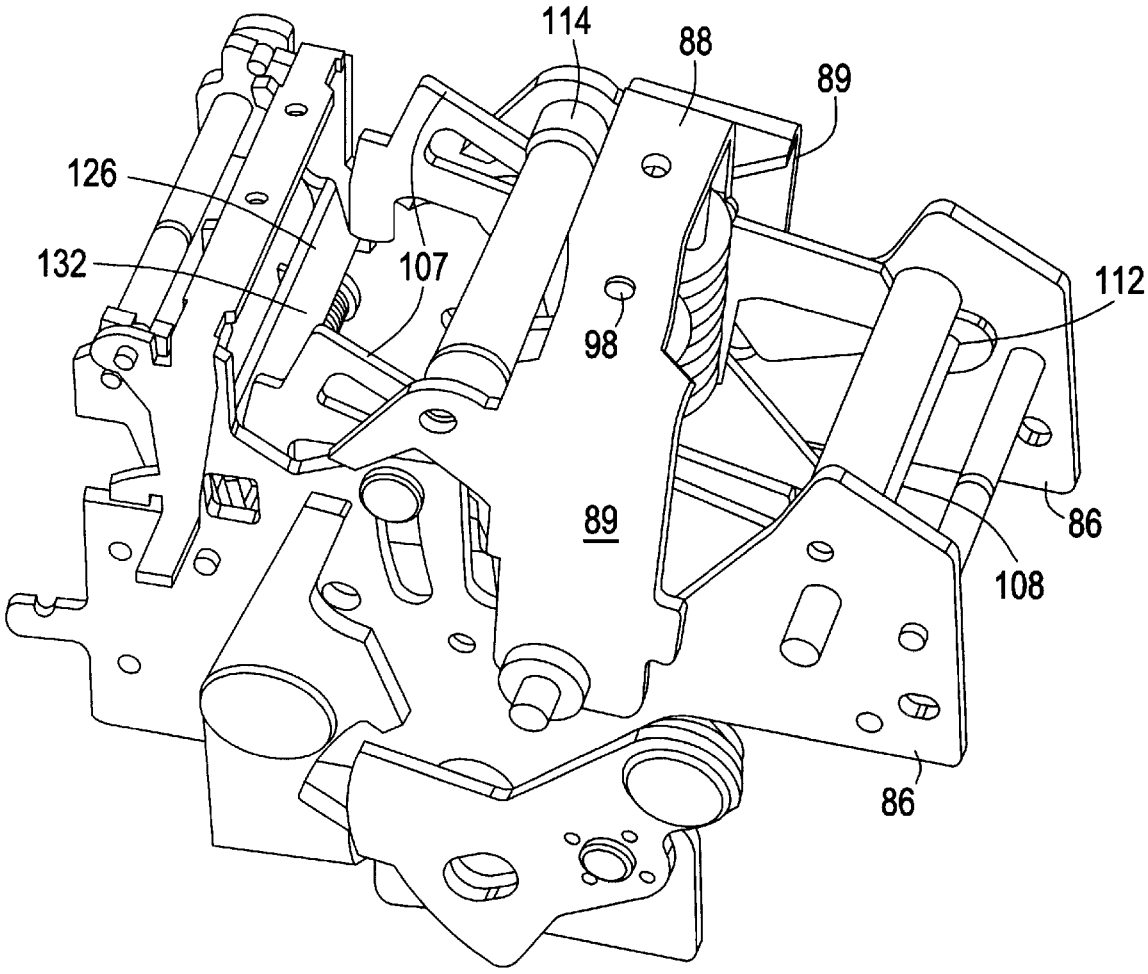
FIG. 6 is an isometric view of the operating mechanism.
Figure 7:
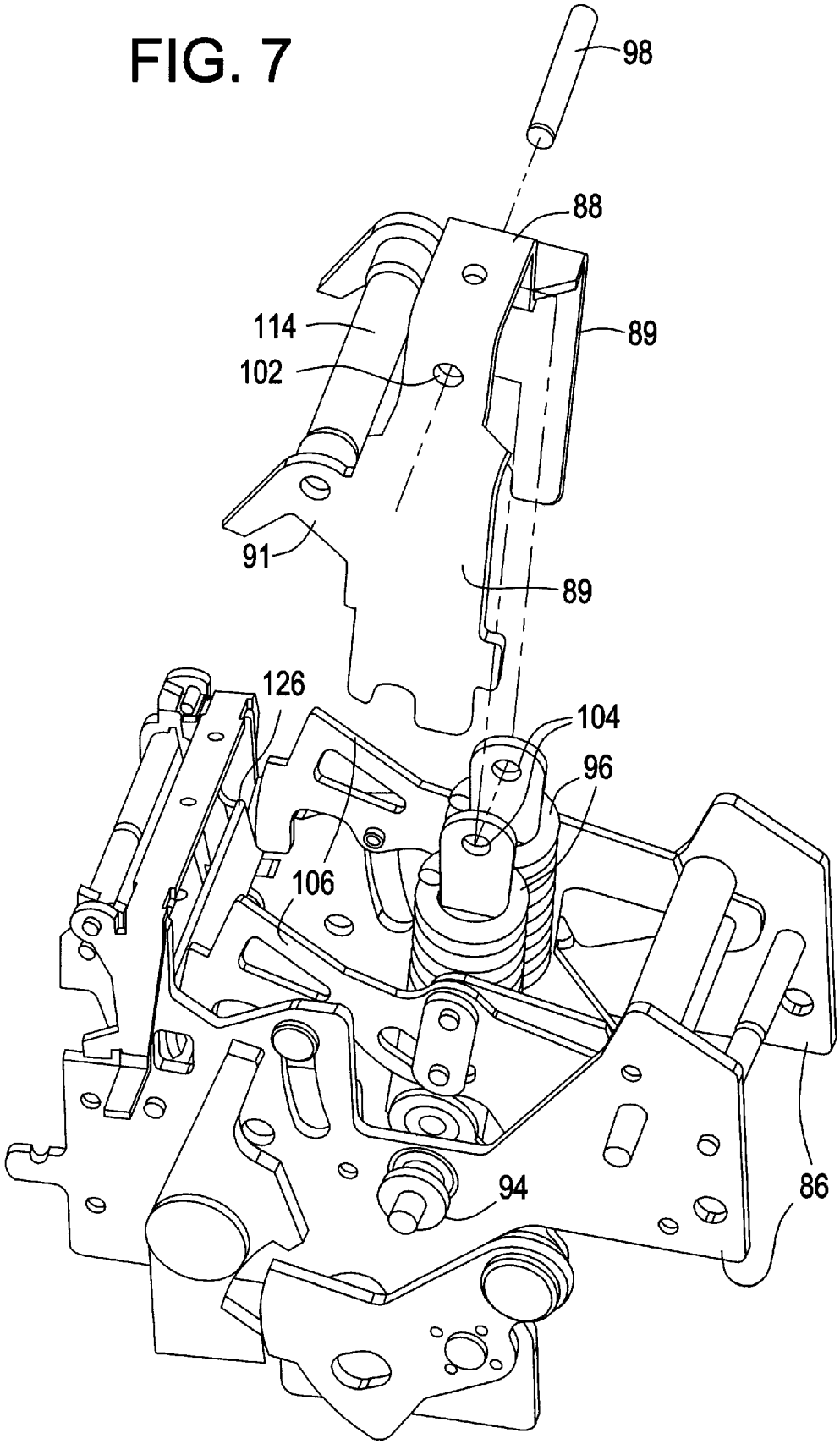
FIG. 7 is a partially exploded view of the operating mechanism.
Figure 8:
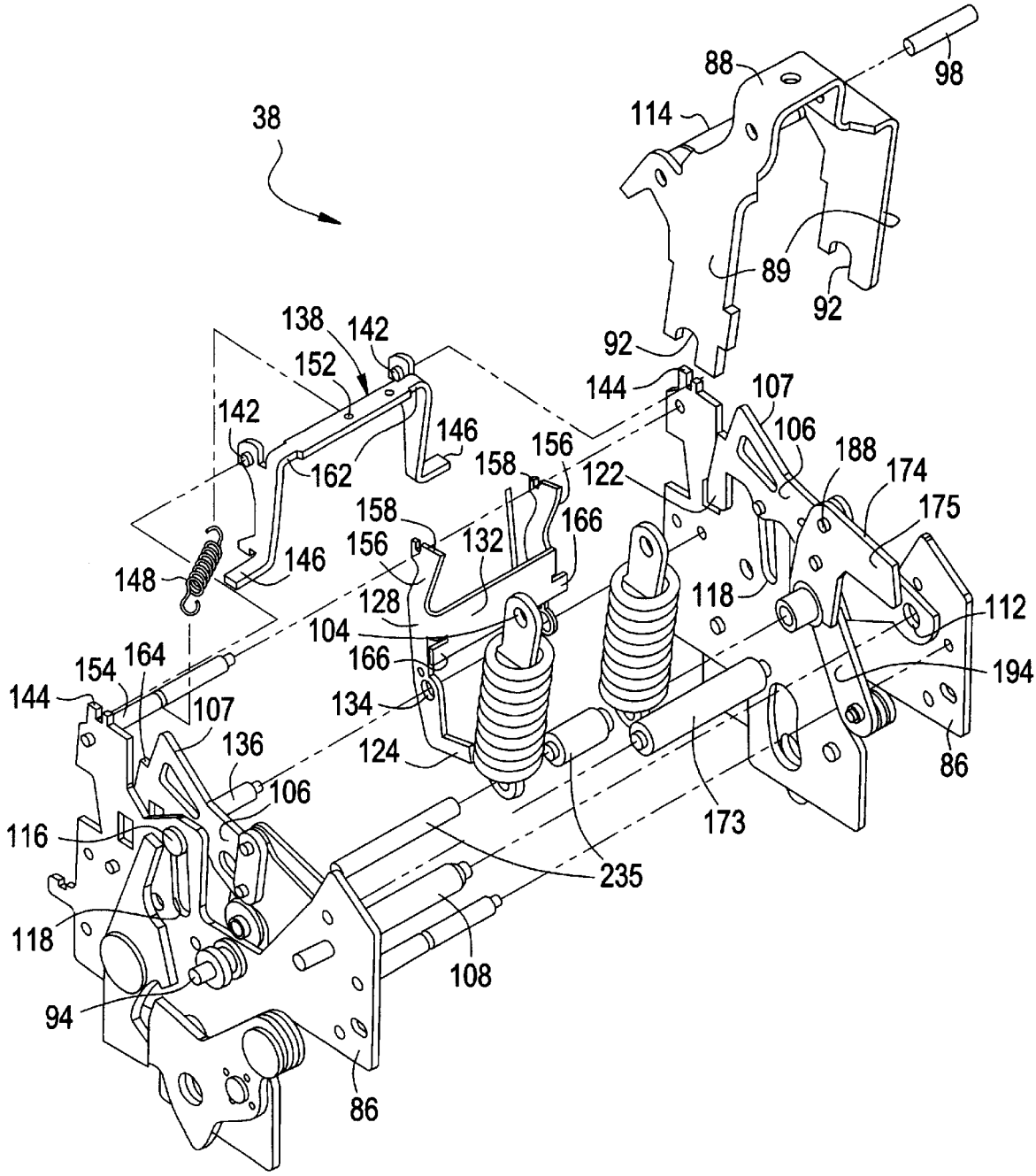
FIG. 8 is another partially exploded view of the operating mechanism.

Referring now to FIGS. 6–8, the components of operating mechanism 38 will now be detailed. As viewed in FIGS. 6–8, operating mechanism 38 is in the "tripped" position. Operating mechanism 38 has operating mechanism side frames 86 configured and positioned to straddle sidewalls 46, 48 of cassette 34 (FIG. 2).

Toggle handle 44 (FIG. 2) is rigidly interconnected with a drive member or handle yoke 88. Handle yoke 88 includes opposing side portions 89. Each side portion 89 includes an extension 91 at to the top of side portion 89, and a U-shaped portion 92 at the bottom portion of each side portion 89. U-shaped portions 92 are rotatably positioned on a pair of bearing portions 94 protruding outwardly from side frames 86. Bearing portions 94 are configured to retain handle yoke 88, for example, with a securement washer. Handle yoke 88 further includes a roller pin 114 extending between extensions 91.

Handle yoke 88 is connected to a set of powerful mechanism springs 96 by a spring anchor 98, which is generally supported within a pair of openings 102 in handle yoke 88 and arranged through a complementary set of openings 104 on the top portion of mechanism springs 96.

Figure 9:
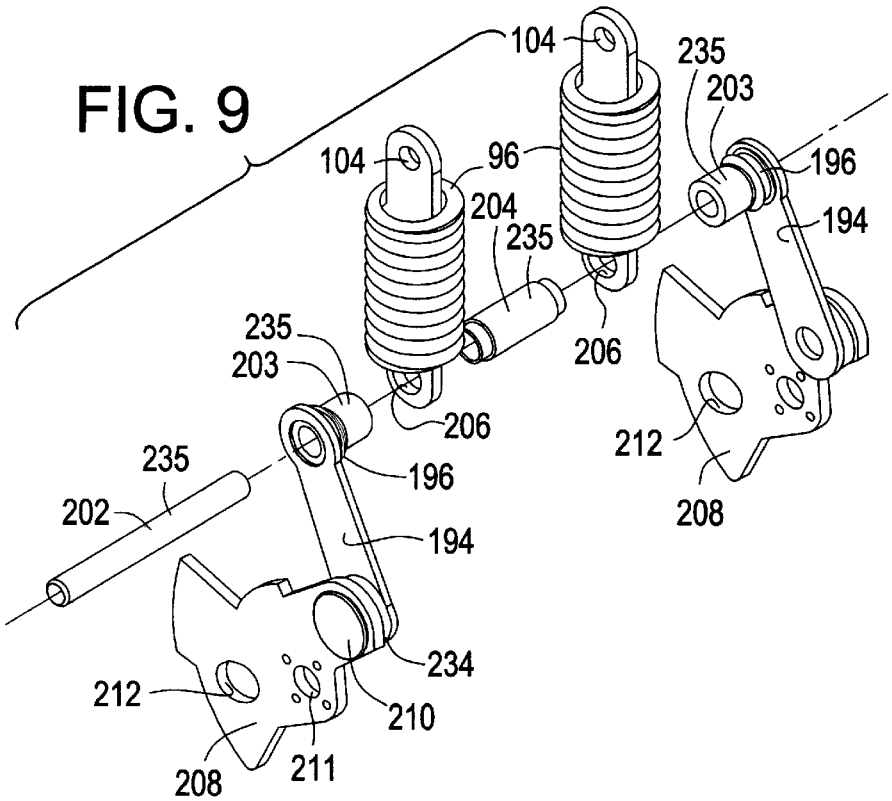
FIG. 9 is an exploded view of a pair of mechanism springs and associated linkage components within the operating mechanism.

Referring to FIG. 9, the bottom portion of mechanism springs 96 include a pair of openings 206. A drive connector 235 operative couples mechanism springs 96 to other operating mechanism components. Drive connector 235 comprises a pin 202 disposed through openings 206, a set of side tubes 203 arranged on pin 202 adjacent to the outside surface of the bottom portion of mechanism springs 96, and a central tube 204 arranged on pin 202 between the inside surfaces of the bottom portions of mechanism springs 96. Central tube 204 includes step portions at each end, generally configured to maintain a suitable distance between mechanism springs 96. While drive connector 235 is detailed herein as tubes 203, 204 and a pin 202, any means to connect the springs to the mechanism components are contemplated.

Figure 10:
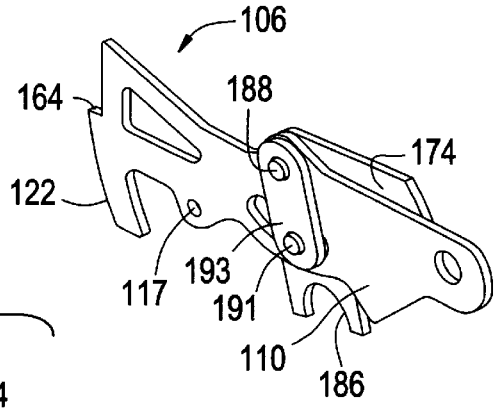
FIGS. 10 and 11 are an isometric and exploded view, respectively, of linkage components within the operating mechanism.
Figure 11:
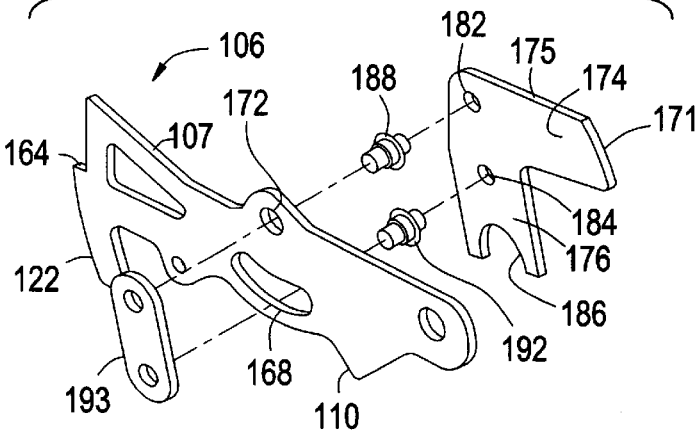
Figure 12:
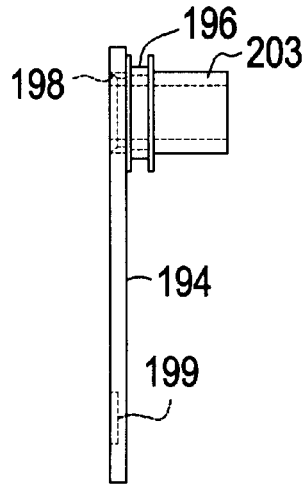
FIGS. 12, 13, and 14 are a front, isometric, and partially exploded isometric view, respectively, of a linkage component within the operating mechanism.
Figure 13:
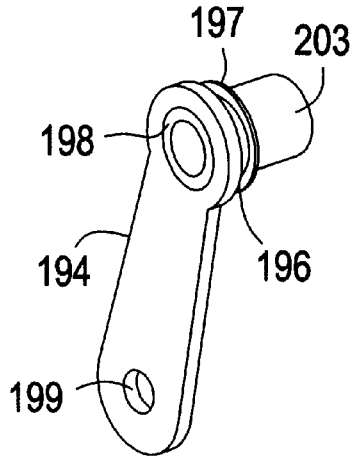
Figure 14:
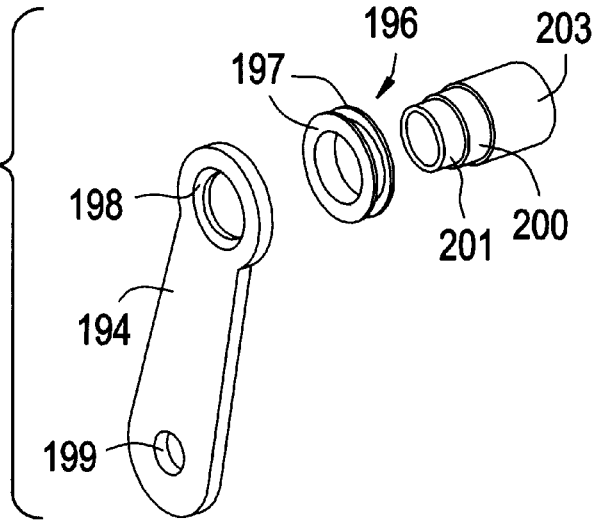

Referring to FIGS. 8, 10 and 11, a pair of cradles 106 are disposed adjacent to side frames 86 and pivot on a pin 108 disposed through an opening 112 approximately at the end of each cradle 106. Each cradle 106 includes an edge surface 107, an arm 122 depending downwardly, and a cradle latch surface 164 above arm 122. Edge surface 107 is positioned generally at the portion of cradle 106 in the range of contact with roller pin 114. Each cradle 106 also includes a stop surface 110 formed thereon. The movement of each cradle 106 is guided by a rivet 116 disposed through an arcuate slot 118 within each side frame 86. Rivets 116 are disposed within an opening 117 on each the cradle 106. An arcuate slot 168 is positioned intermediate to opening 112 and opening 117 on each cradle 106. An opening 172 is positioned above slot 168.

Referring back to FIGS. 6–8, a primary latch 126 is positioned within side frames 86. Primary latch 126 includes a pair of side portions 128 (FIG. 8). Each side portion 128 includes a bent leg 124 at the lower portion thereof. Side portions 128 are interconnected by a central portion 132. A set of extensions 166 depend outwardly from central portion 132 positioned to align with cradle latch surfaces 164.

Side portions 128 each include an opening 134 positioned so that primary latch 126 is rotatably disposed on a pin 136. Pin 136 is secured to each side frame 86. A set of upper side portions 156 are defined at the top end of side portions 128. Each upper side portion 156 has a primary latch surface 158.

A secondary latch 138 is pivotally straddled over side frames 86. Secondary latch 138 includes a set of pins 142 disposed in a complementary pair of notches 144 on each side frame 86. Secondary latch 138 includes a pair of secondary latch trip tabs 146 that extend perpendicularly from operating mechanism 38 as to allow an interface with, for example, an actuator (not shown), to release the engagement between primary latch 126 and secondary latch 138 thereby causing operating mechanism 38 to move to the "tripped" position (e.g., as in FIG. 5), described below. Secondary latch 138 includes a set of latch surfaces 162, that align with primary latch surfaces 158.

Secondary latch 138 is biased in the clockwise direction due to the pulling forces of a spring 148. Spring 148 has a first end connected at an opening 152 upon secondary latch 138, and a second end connected at a frame cross pin 154 disposed between frames 86.

Referring to FIGS. 8, 10 and 11, a set of upper links 174 are connected to cradles 106. Upper links 174 generally have a right angle shape. Legs 175 (in a substantially horizontal configuration and FIGS. 8 and 11) of upper links 174 each have a cam portion 171 that interfaces a roller 173 disposed between frames 86. Legs 176 (in a substantially vertical configuration in FIGS. 8 and 10) of upper links 174 each have a pair of openings 182, 184 and a U-shaped portion 186 at the bottom end thereof. Opening 184 is intermediate to opening 182 and U-shaped portion 186. Upper links 174 connect to cradle 106 via a securement structure such as a rivet pin 188 disposed through opening 172 and opening 182, and a securement structure such as a rivet pin 191 disposed through slot 168 and opening 184. Rivet pins 188, 191 both attach to a connector 193 to secure each upper link 174 to each cradle 106. Each pin 188, 191 includes raised portions 189, 192, respectively. Raised portions 189, 192 are provided to maintain a space between each upper link 174 and each cradle 106. The space serves to reduce or eliminate friction between upper link 174 and cradle 106 during any operating mechanism motion, and also to spread force loading between cradles 106 and upper links 174.

Upper links 174 are each interconnected with a lower link 194. Referring now to FIGS. 8–14, U-shaped portion 186 of each upper link 174 is disposed in a complementary set of bearing washers 196. Bearing washers 196 are arranged on each side tube 203 between a first step portion 200 of side tube 203 and an opening 198 at one end of lower link 194. Bearing washers 196 are configured to include side walls 197 spaced apart sufficiently so that U-shaped portions 186 of upper links 174 fit in bearing washer 196. Each side tube 203 is configured to have a second step portion 201. Each second step portion 201 is disposed through openings 198. Pin 202 is disposed through side tubes 203 and central tube 204. Pin 202 interfaces upper links 174 and lower links 194 via side tubes 203. Therefore, each side tube 203 is a common interface point for upper link 174 (as pivotally seated within side walls 197 of bearing washer 196), lower link 194 and mechanism springs 96.

Figure 15:
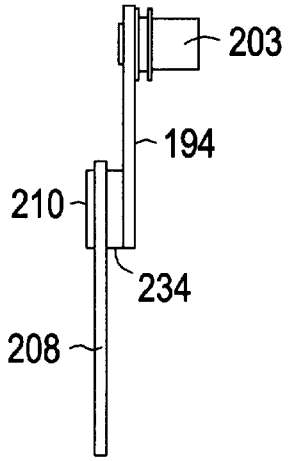
FIGS. 15, 16, and 17 are a front, isometric, and partially exploded isometric view, respectively, of linkage components within the operating mechanism.
Figure 16:
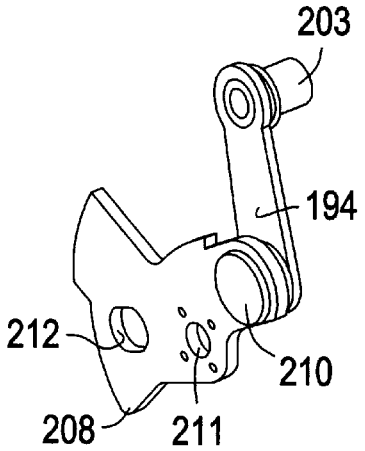
Figure 17:
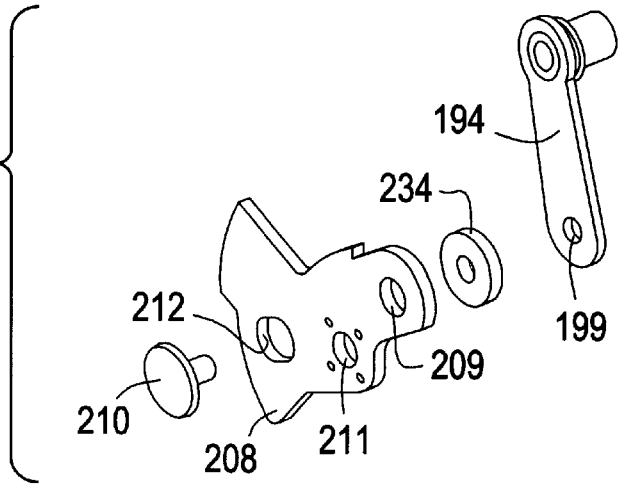

Referring to FIGS. 15–17, each lower link 194 is interconnected with a crank 208 via a pivotal rivet 210 disposed through an opening 199 in lower link 194 and an opening 209 in crank 208. Each crank 208 pivots about a center 211. Crank 208 has an opening 212 where cross pin 40 (FIG. 2) passes through into arcuate slot 52 of cassettes 32, 34 and 36 (FIG. 2) and a complementary set of arcuate slots 214 on each side frame 86 (FIG. 8).

A spacer 234 is included on each pivotal rivet 210 between each lower link 194 and crank 208. Spacers 234 spread the force loading from lower links 194 to cranks 208 over a wider base, and also reduces friction between lower links 194 and cranks 208, thereby minimizing the likelihood of binding (e.g., when operating mechanism 38 is changed from the "off" position to the "on" position manually or mechanically, or when operating mechanism 38 is changed from the "on" position to the "tripped" position of the release of primary latch 126 and secondary latch 138).

Referring back to FIGS. 3–5, the movement of operating mechanism 38 relative to rotary contact assembly 56 will be detailed.

Referring to FIG. 3, in the "off" position toggle handle 44 is rotated to the left and mechanism springs 96, lower link 194 and crank 208 are positioned to maintain contact arm 68 so that movable contacts 72, 74 remain separated from stationary contacts 64, 66. Operating mechanism 38 becomes set in the "off" position after a reset force properly aligns primary latch 126, secondary latch 138 and cradle 106 (e.g., after operating mechanism 38 has been tripped) and is released. Thus, when the reset force is released, extensions 166 of primary latch 126 rest upon cradle latch surfaces 164, and primary latch surfaces 158 rest upon secondary latch surfaces 162. Each upper link 174 and lower link 194 are bent with respect to each side tube 203. The line of forces generated by mechanism springs 96 (i.e., between spring anchor 98 and pin 202) is to the left of bearing portion 94 (as oriented in FIGS. 3–5). Cam surface 171 of upper link 174 is out of contact with roller 173.

Referring now to FIG. 4, a manual closing force was applied to toggle handle 44 to move it from the "off" position (i.e., FIG. 3) to the "on" position (i.e., to the right as oriented in FIG. 4). While the closing force is applied, upper links 174 rotate within arcuate slots 168 of cradles 106 about pins 188, and lower link 194 is driven to the right under bias of the mechanism spring 96. Raised portions 189 and 192 (FIGS. 10 and 11) maintain a suitable space between the surfaces of upper links 174 and cradles 106 to prevent friction therebetween, which would increase the required set operating mechanism 38 from "off" to "on". Furthermore, side walls 197 of bearing washers 196 (FIGS. 12–14) maintain the position of upper link 174 on side tube 203 and minimize likelihood of binding (e.g., so as to prevent upper link 174 from shifting into springs 96 or into lower link 194).

To align vertical leg 176 and lower link 194, the line of force generated by mechanism springs 96 is shifted to the right of bearing portion 94, which causes rivet 210 coupling lower link 194 and crank 208 to be driven downwardly and to rotate crank 208 clockwise about center 211. This, in turn, drives cross pin 40 to the upper end of arcuate slot 214. Therefore, the forces transmitted through cross pin 40 to rotary contact assembly 56 via opening 82 drive movable contacts 72, 74 into stationary contacts 64, 66. Each spacer 234 on pivotal rivet 210 (FIGS. 9 and 15–7) maintain the appropriate distance between lower links 194 and cranks 208 to prevent interference or friction therebetween or from side frames 86.

The interface between primary latch 126 and secondary latch 138 (i.e., between primary latch surface 158 and secondary latch surface 162), and between cradles 106 and primary latch 126 (i.e., between extensions 166 and cradle latch surfaces 164) is not affected when a force is applied to toggle handle 44 to change from the "off" position to the "on" position.

Referring now to FIG. 5, in the "tripped" condition, secondary latch trip tab 146 has been displaced (e.g., by an actuator, not shown), and the interface between primary latch 126 and secondary latch 138 is released. Extensions 166 of primary latch 126 are disengaged from cradle latch surfaces 164, and cradles 106 is rotated clockwise about pin 108 (i.e., motion guided by rivet 116 in arcuate slot 118). The movement of cradle 106 transmits a force via rivets 188, 191 to upper link 174 (having cam surface 171). After a short predetermined rotation, cam surface 171 of upper link 174 contacts roller 173. The force resulting from the contact of cam surface 171 on roller 173 causes upper link 174 and lower link 194 to buckle and allows mechanism springs 96 to pull lower link 194 via pin 202. In turn, lower link 194 transmits a force to crank 208 (i.e., via rivet 210), causing crank 208 to rotate counter clockwise about center 211 and drive cross pin 40 to the lower portion of arcuate slot 214. The forces transmitted through cross pin 40 to rotary contact assembly 56 via opening 82 cause movable contacts 72, 74 to separate from stationary contacts 64, 66.

Figure 18:
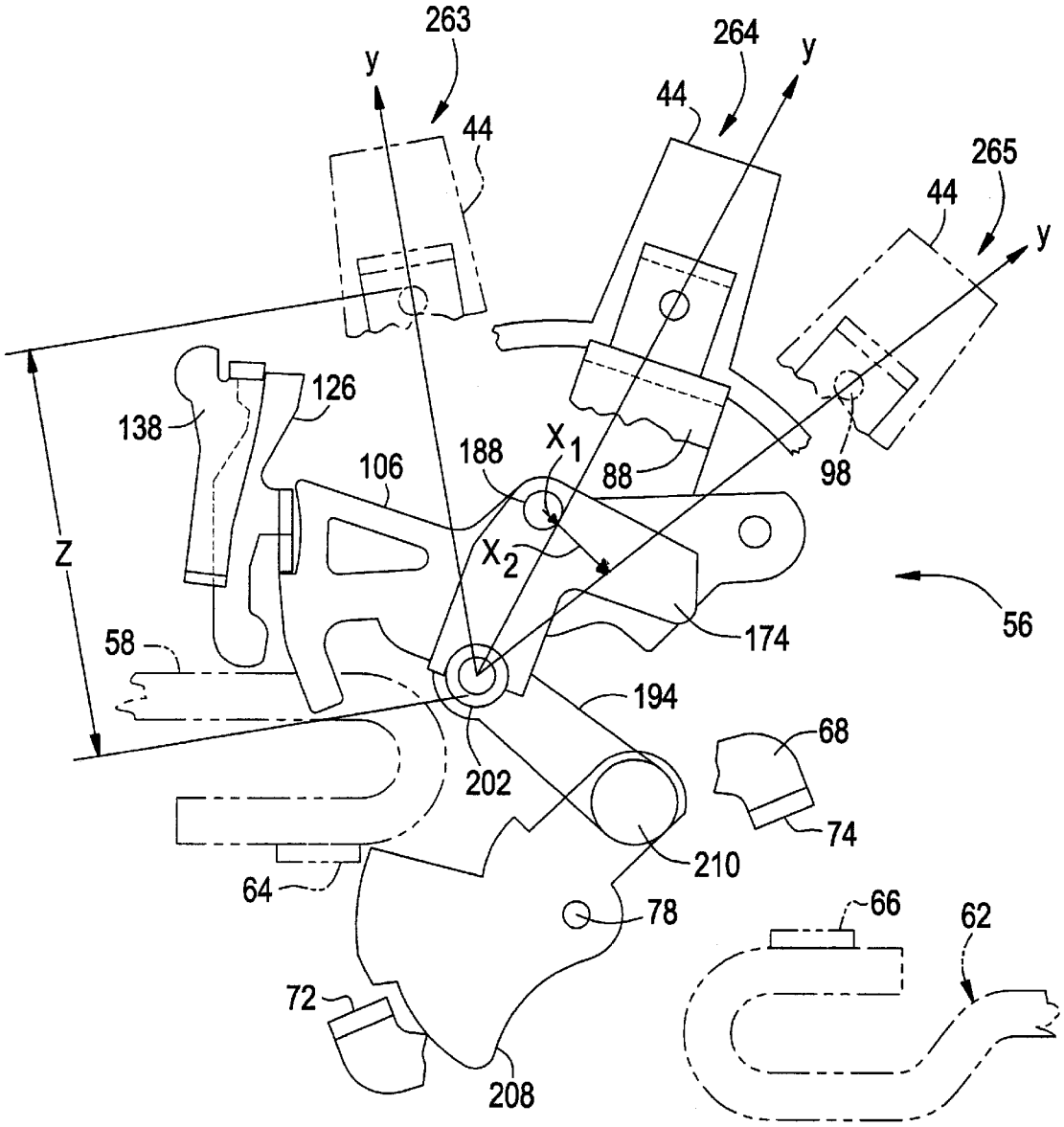
FIG. 18 is a partial sectional view of a rotary contact structure and operating mechanism in the "off" position.

FIG. 18 shows the movable contact assembly 56 in the "off" (open) position. The "z" distance represents the length of the mechanism (operating) springs 96. As the handle 44 is rotated from open position 263 to the closed position 265, the "z" distance increases, creating greater closing force output within the springs 96. The closing spring force is always directed through the anchor points of springs 96, spring anchor 98 and pin 202, as depicted by line "y". When the line "y" passes to the right of upper link pivot pin 188, a moment arm of length "x" is created perpendicular to line "y" and through the center of pin 188. When line "y" creates a sufficient moment arm "x" about pin 188, as at the initial close position 264, the upper link assembly 174 will rotate in a counterclockwise direction and close the contact arm 68 as described hereinbefore with reference to FIG. 4. Line "y" placed in this "initial closed position" will allow the operating mechanism 38 to create a particular amount of closing output. However, if line "y" is allowed to go to the "full closed position", the closing output of the mechanism 38 is greatly increased due to the fact that moment arm "x" is a greater length and the length of springs 96, depicted as "z", is also greater. When closing the contacts 64, 72, 74 and 66, the handle 44 is normally rotated to its "full closed position". However, this is not always the case. The handle 44 may be moved to less than the full closed position and, since closing initiates when the "x" moment arm is relatively short, the rate at which the handle 44 is rotated to the full closed position can affect the closing output of the operating mechanism 38.

Figure 19:
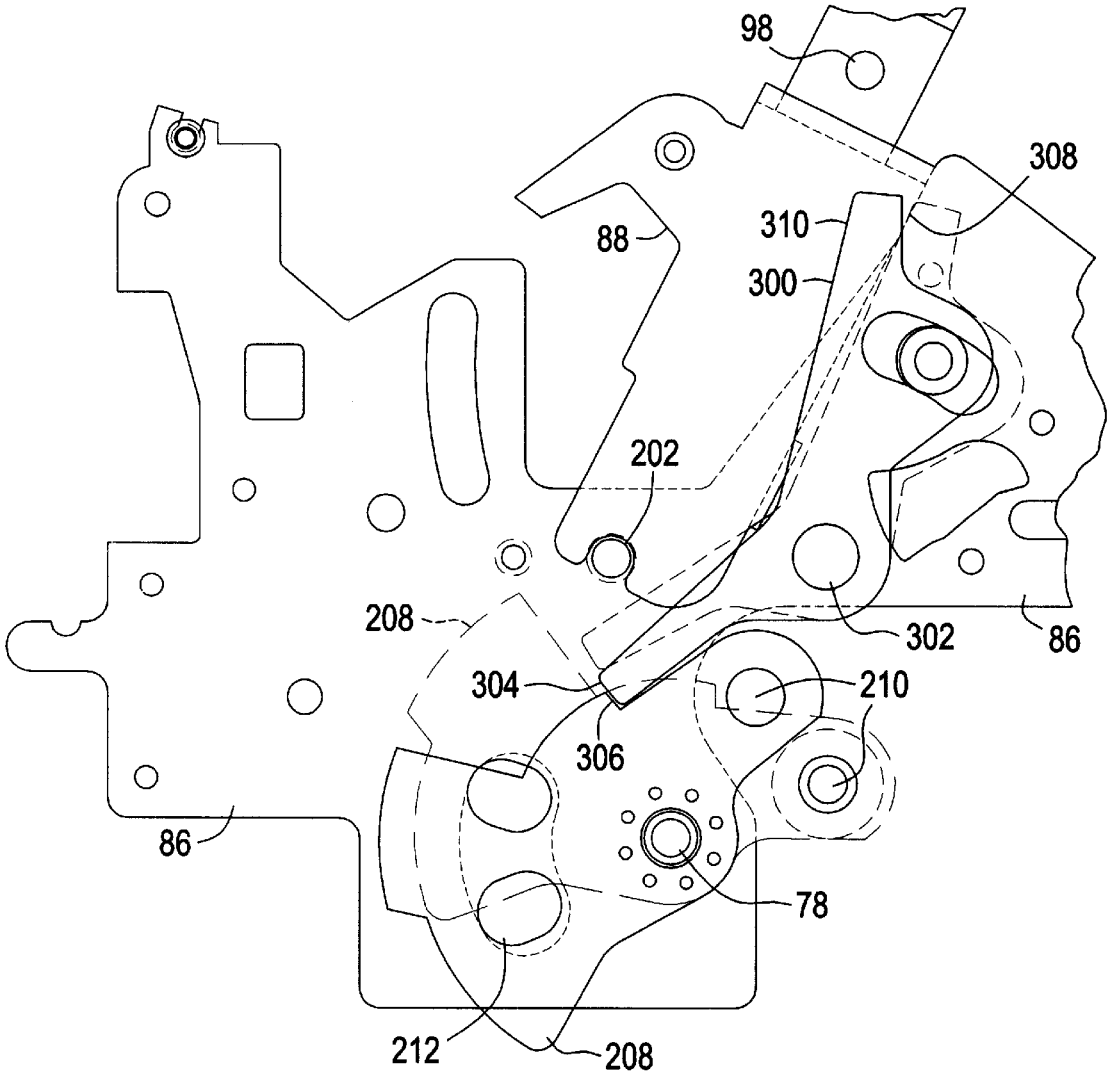
FIG. 19 is a side view of the blocking prop and driving bell crank of the operating mechanism of the present invention.

The present invention allows the contacts 64, 72, 74, and 66 to be blocked from closing by preventing the rotation of crank 208 until a predetermined distance "x" and a length "z" are achieved, thereby generating a predetermined moment on upper link 174 around rivet pin 188. As shown in FIG. 19, a blocking prop 300 is pivotally secured to the outside of the frame 86. Blocking prop 300 is biased in the counterclockwise direction about a pivot pin 302 by spring (not shown). An end 304 of blocking prop 300 engages crank 208 at an interface 306 formed on crank 208 to block crank 208 from closing (i.e., rotating in a clockwise direction about center 78). When the handle yoke 88 is rotated to a predetermined position such that the predetermined distance "x" and length "z" are achieved, an edge 308 of handle yoke 88 will come into contact with a surface 310, which is formed on an end of blocking prop 300 opposite the end 304 in contact with interface 306. As handle yoke 88 rotates clockwise, contact between edge 308 and surface 310 causes blocking prop 300 to rotate clockwise, moving end 304 out of engagement with interface 306. Once interface 306 is free from end 304 of blocking prop 300, crank 208 is free to rotate in the clockwise direction to close contacts 64, 72, 74, and 66.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An operating mechanism for a circuit breaker having a contact arm having a movable contact and an associated fixed contact, said operating mechanism comprising:

a movable handle yoke;

a mechanism spring extending in tension from said handle yoke to a pin;

a lower link extending from said pin to a crank operably connected to said contact arm, said crank positionable in an open position and a closed position, said crank being in said open position when said movable contact is separated from the associated fixed contact, said crank being in said closed position when said movable contact is mated to said associated fixed contact;

an interface formed on said crank;

a blocking prop having a first surface that engages said interface, said first surface preventing said crank from rotating towards said closed position;

an upper link having a bearing at a lower end limiting movement of said pin; and a cradle, said upper link attached to said cradle at a rivet pin at an upper end, said cradle and upper link configured to allow limited range of rotation with respect to one another on said rivet pin, said upper link being at a first extreme of the limited range of rotation when the handle yoke is in an off position and said upper link is at a second extreme of the limited range of rotation when the handle yoke is fully in the on position, and said blocking prop configured to prevent said crank from rotating to the closed position until said mechanism spring exerts a predetermined moment on said upper link tending to cause said upper link to rotate from said first extreme to said second extreme.

2. The operating mechanism of claim 1 wherein said blocking prop includes a second surface that interacts with said handle yoke as said handle yoke moves from an off position to an on position, causing said blocking prop to rotate, which in turn causes said first surface to disengage from the interface formed on said crank, thus allowing said crank to rotate to said closed position under the influence of said mechanism spring.

3. The operating mechanism of claim 2 wherein said blocking prop is configured to prevent said crank from rotating until said handle yoke reaches a predetermined position as it is moved from an off position to an on position, thereby ensuring a minimum closing force exerted on said crank.

4. A circuit breaker comprising:

a movable handle yoke;

a mechanism spring extending in tension from said handle yoke to a pin;

a lower link extending from said pin to a crank operably connected to a contact arm bearing a movable contact, said crank positionable in an open position and a closed position, said crank being in said open position when said movable contact is separated from an associated fixed contact said crank being in said closed position when said movable contact is mated to said associated fixed contact;

an interface formed on said crank;

a blocking prop having a first surface that engages said interface, said first surface preventing said crank from rotating towards said closed position;

an upper link having a bearing at a lower end limiting movement of said pin; and a cradle, said upper link attached to said cradle at a rivet pin at an upper end, said cradle and upper link configured to allow limited range of rotation with respect to one another on said rivet pin, said upper link being at a first extreme of the limited range of rotation when the handle yoke is in an off position and said upper link is at a second extreme of the limited range of rotation when the handle yoke is fully in the on position, and said blocking prop configured to prevent said crank from rotating to the closed position until said mechanism spring exerts a predetermined moment on said upper link tending to cause said upper link to rotate from said first extreme to said second extreme.

5. The circuit breaker of claim 4 wherein said blocking prop includes a second surface that interacts with said handle yoke as said handle yoke moves from an off position to an on position, causing said blocking prop to rotate, which in turn causes said first surface to disengage from the interface formed on said crank, thus allowing said crank to rotate to said closed position under the influence of said mechanism spring.

6. The circuit breaker of claim 5 wherein said blocking prop is configured to prevent said crank from rotating until said handle yoke reaches a predetermined position as it is moved from an off position to an on position, thereby ensuring a minimum closing force exerted on said crank.

7. A circuit breaker comprising:

a contact arm bearing a movable contact;

a fixed contact associated with said movable contact;

a crank operably connected to said contact arm, said crank positionable in an open position and a closed position, said crank being in said open position when said movable contact is separated from said fixed contact, and said crank being in said closed position when said movable contact is mated to said fixed contact;

a handle yoke movable between an off and an on position;

a pin;

a mechanism spring extending from said handle yoke to said pin;

a lower link extending between said pin and said crank;

a cradle;

an upper link extending between said pin and said cradle, said upper link being at a first position relative to said cradle when said handle yoke is in an off position, and said upper link being at a second position relative to said cradle when said handle yoke is in an on position; and a blot king prop including:

a first surface that releasably engages said crank, said first surface preventing said crank from rotating towards said closed position, and a second surface that interacts with said handle yoke as said handle yoke moves from said off position to said on position, causing said blocking prop to rotate, which in turn causes said first surface to disengage from said crank, thus allowing said crank to rotate to said closed position under the influence of said mechanism spring.

8. The circuit breaker of claim 7, wherein said upper link is configured to have a limited range of movement relative to said cradle, said upper link being at a first extreme of the limited range of movement when the handle yoke is in an off position and said upper link being at a second extreme of the limited range of movement when the handle yoke is fully in the on position.

* * * * *